US005546642A

United States Patent [19]

Anscher

[11] Patent Number: 5,546,642

[45] Date of Patent: Aug. 20, 1996

[54] SIDE-RELEASE BUCKLE FASTENER

[75] Inventor: Joseph Anscher, Muttontown, N.Y.

[73] Assignee: National Molding Corporation, Frmingdale, N.Y.

[21] Appl. No.: 286,610

[22] Filed: Aug. 5, 1994

[51] Int. Cl.[6] ..... A44B 11/26

[52] U.S. Cl. ..... 24/625; 24/606

[58] Field of Search ..... 24/625, 616, 615, 24/614, 633, 606, 607

[56] References Cited

U.S. PATENT DOCUMENTS

| | | | |
|---|---|---|---|
| 3,251,110 | 5/1966 | Hedu . | |
| 3,798,711 | 3/1974 | Cousins . | |
| 3,967,351 | 7/1976 | Rosenberg et al. . | |
| 4,035,877 | 7/1977 | Brownson et al. . | |
| 4,150,464 | 4/1979 | Tracy . | |
| 4,171,555 | 10/1979 | Bakker et al. | 24/200 |
| 4,425,689 | 1/1984 | Fildan | 24/664 |
| 4,577,377 | 3/1986 | Kasai | 24/625 |
| 4,672,725 | 6/1987 | Kasai | 24/625 |
| 4,688,337 | 8/1987 | Dillner et al. | 24/616 |
| 4,987,661 | 1/1991 | Kasai | 24/625 |
| 5,131,122 | 7/1992 | Lavato | 24/625 |
| 5,222,279 | 6/1993 | Frano et al. | 24/625 |

FOREIGN PATENT DOCUMENTS 2127090 4/1984 United Kingdom .

2262962 7/1993 United Kingdom .

*Primary Examiner*—James R. Brittain
*Attorney, Agent, or Firm*—Kenyon & Kenyon

[57] ABSTRACT

In accordance with the present invention, a two-piece side-release buckle is provided comprising releasably connectable male and female members. The male member includes a strap connector base portion on which a strap or a belt may be attached. The male member also includes two resilient arms extending outwardly from the base portion. The arms each include at a free end distal to the base portion separate upper and lower abutment surfaces. The upper and lower abutment surfaces are discrete and spaced-apart from each other. The female member includes a body with a cavity therein, in which the arms of the male member may be inserted for coupling the male and female members. The body includes retaining surfaces in the cavity that are adapted for engaging one of the abutment surfaces of the male member when the male and female members are coupled to securely lock the members together. The female member also includes two actuating members that, when pressed, act against the arms and cause the abutment surfaces of each arm to become disengaged from the corresponding retaining surfaces in the body to enable the male and female members to be quickly and easily separated when desired. The female member also includes a strap cross-member on which a strap or belt may be attached at an end thereof distal to the male member.

31 Claims, 6 Drawing Sheets

FIG. 3
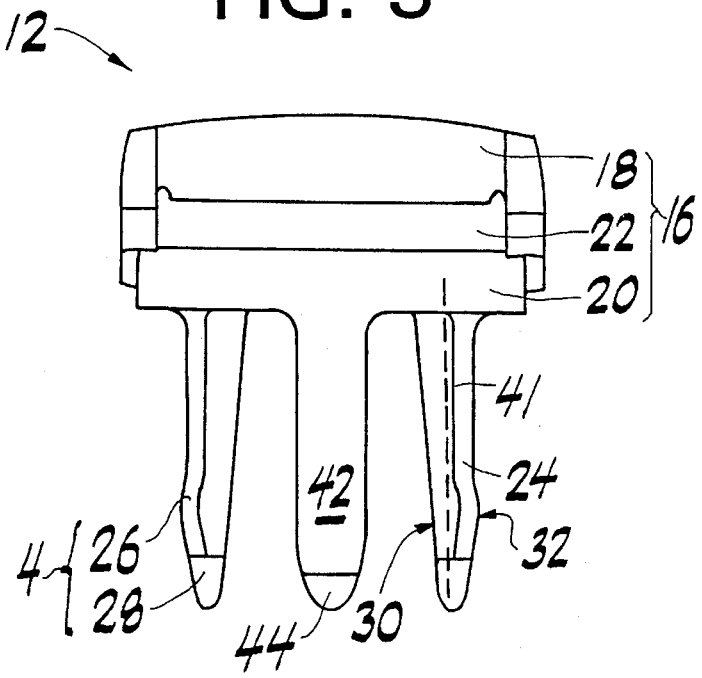
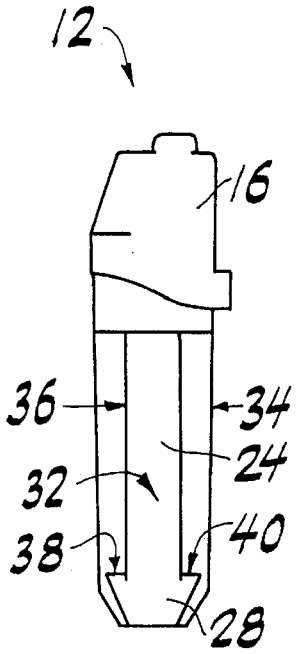
FIG. 4
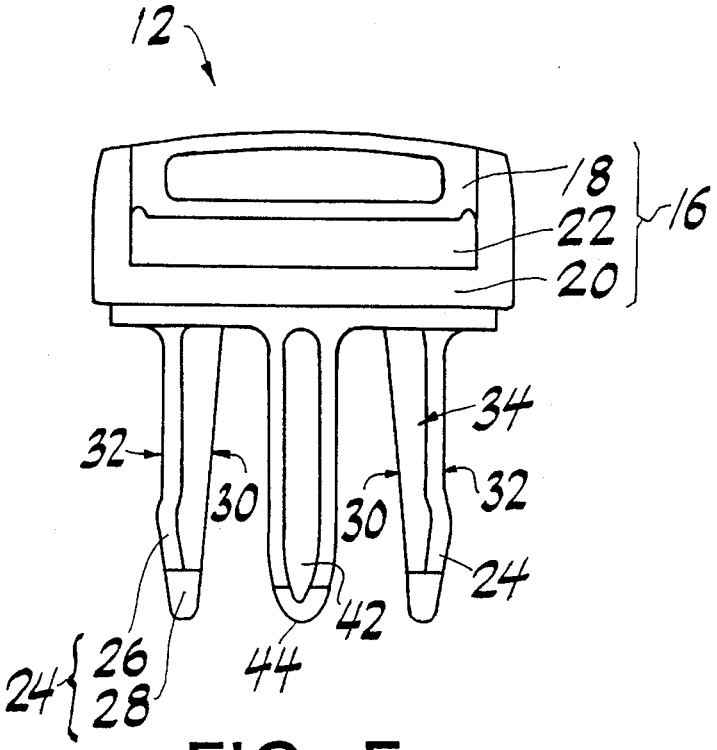
FIG. 5

SIDE-RELEASE BUCKLE FASTENER

FIELD OF THE INVENTION

The present invention relates generally to two-piece buckle type fasteners and, more particularly, to two-piece side-release buckles.

BACKGROUND

Two-piece buckles comprise releasably connectable male and female members. The buckles are typically used to fasten the ends of belts or straps, wherein each of the male and female members is attached to one end of the belt or strap. The buckles have various applications, but are particularly common in sports and camping equipment like backpacks and life jackets.

The male member of the buckle typically includes a pair of resilient arms that may be inserted and releasably locked in the female member to couple the members. Each arm includes an abutment surface that is releasably engageable with a corresponding retaining surface in the female member to lock the members together. Side-release buckles include recesses at the sides of the female member that expose the arms of the male member such that the male and female members may be uncoupled by pressing the arms of the male member at the side recesses to disengage the abutment and retaining surfaces.

U.S. Pat. Nos. 4,577,377; 4,672,725; and 4,987,661 all issued to Kasai, disclose two-piece side-release buckles wherein the female member includes a pair of external actuating members. The actuating members, when pressed, act against the arms of the male member and cause the abutment and retaining surfaces on the male and female members, respectively, to become disengaged. The actuating members are not connected to the male member and can thus extend outwardly from the buckle, making the buckle easier to uncouple by a user wearing gloves or mittens.

One problem with known buckles like those described above is that when large loads are applied to the buckles, the arms of the male member tend to flex inwardly, causing the abutment and retaining surfaces to disengage and leading to an inadvertent separation of the male and female members.

U.S. Pat. No. 5,222,279 issued to Frano and U.K. Patent Publication No. 2,262,962 to Fudaki each disclose buckles comprising a male member having arms, portions of which are engageable with the female member. The engageable portions are noted to be located at positions on the arms such that torque at the arms is reduced to lessen the chance of inadvertent separation. In each reference, however, the arms are designed to perform both engagement and disengagement functions; the arms include portions exposed through side openings in the female member that can be pressed to uncouple the parts. Accordingly, the arms in the male member must De widely spaced-apart and located in close proximity with the sides of the female member. The female member must also include ramps and engagement surfaces proximate its sides engageable by the arms. Therefore, brackets in accordance with these prior art references must be substantially wide in order to accommodate the design of the parts therein and cannot be made suitably compact. Another problem with the buckles disclosed in the prior art references is that it is often difficult to uncouple the male and female parts because the arms of the male member must be directly pressed by the user of the buckle and the engaging portions of the arms must be moved a sufficient distance to disengage the parts. The uncoupling process is especially difficult if the user is wearing gloves or mittens.

OBJECTS AND SUMMARY OF THE INVENTION

An object of the present invention is to provide a two-piece side release buckle that remains securely coupled even when high loads are applied to pull apart the buckle.

Another object of this invention is to provide a compact two-piece side-release buckle that can be securely coupled.

A further object of the invention is to provide a two-piece side release buckle that can be readily uncoupled when desired.

In accordance with the present invention, a two-piece side-release buckle is provided comprising releasably connectable male and female members. The male member includes a strap connector base portion on which a strap or a belt may be attached. The male member also includes two resilient arms extending outwardly from the base portion. The arms each include at a free end distal to the base portion separate upper and lower abutment surfaces. The upper and lower abutment surfaces are discrete and spaced-apart from each other. The female member includes a body with a cavity therein, in which the arms of the male member may be inserted for coupling the male and female members. The body includes retaining surfaces in the cavity that are each adapted for engaging one of the abutment surfaces of the male member when the male and female members are coupled to securely lock the members together. The female member also includes two actuating members that, when pressed, act against the arms and cause the abutment surfaces of each arm to become disengaged from the corresponding retaining surfaces in the body to enable the male and female members to be quickly and easily separated. The female member also includes a strap cross-member on which a strap or belt may be attached at an end thereof distal to the male member.

BRIEF DESCRIPTION OF THE DRAWINGS

FIG. 3 is a top view of the male member.

FIG. 4 is a right-side view of the male member.

FIG. 5 is a bottom view of the male member.

DETAILED DESCRIPTION

Figure 1:
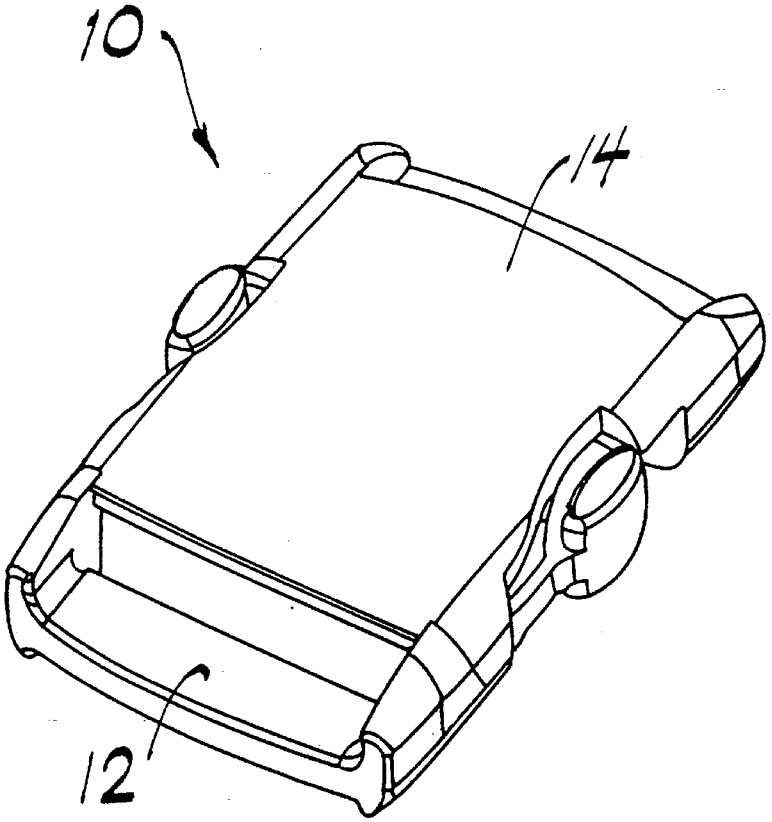
FIG. 1 is a perspective view of a buckle in accordance with the invention comprising releasably coupled male and female members.

FIG. 1 is a perspective view of a side-release buckle fastener or connector 10 in accordance with the present invention. The buckle 10 comprises a plug or male member 12 releasably coupled with a receptacle or female member 14.

While other materials may be used, the male and female members 12, 14 preferably comprise molded plastic.

FIGS. 2 to 6 illustrate the male member 12 in greater detail. The male member 12 includes a strap-connector base portion 16 comprising two spaced-apart cross members 18, 20 having an opening 22 therebetween. A strap, belt or the like (not shown) may be attached to the base portion 16 by inserting an end of the strap through the opening 22, looping it around the outer cross member 18, and sewing it or otherwise attaching it to the rest of the strap. Although not shown, the base portion 16 may also comprise cross-members adapted for adjustably securing a strap or belt.

A pair of resilient arms 24 extend outwardly from the base portion 16 in a direction generally perpendicular to the cross members 18, 20. The arms each include an elongated stem portion 26 and an enlarged portion 28 at the end thereof distal said base portion 16. Each of the arm stems 26 includes opposite inner and outer sides 30 32 wherein the inner side 30 of one arm faces the inner side 30 of the other arm. The arm stems 26 also include opposite upper and lower sides 34, 36 that connect the inner and outer sides 30, 32.

Figure 2:
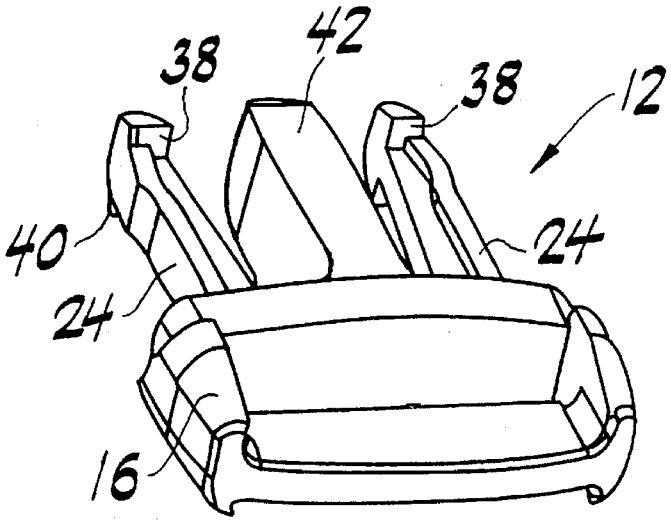
FIG. 2 is a perspective view of the male member in accordance with the invention.
Figure 6:
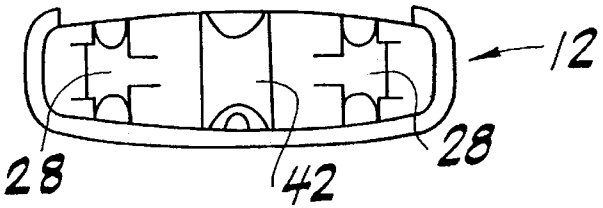
FIG. 6 is a front view of the male member.
Figure 8:
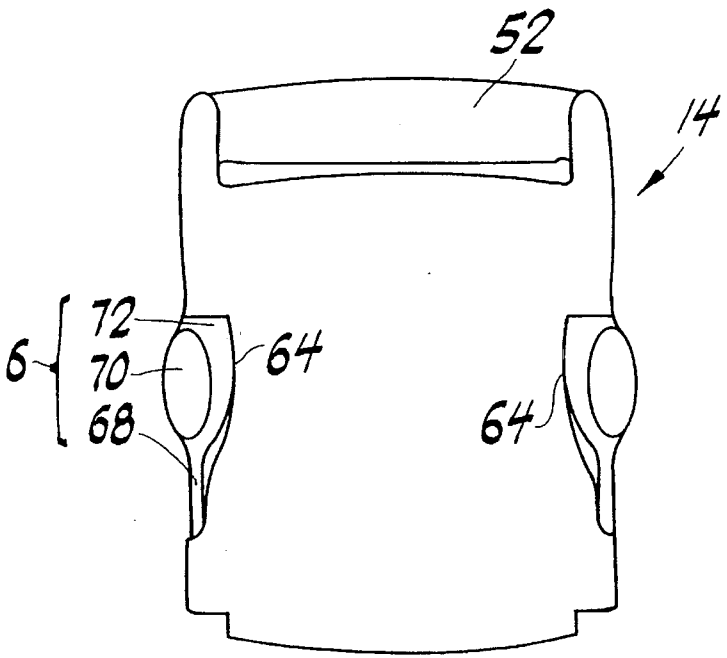
FIG. 8 is a top view of the female member.
Figure 7:
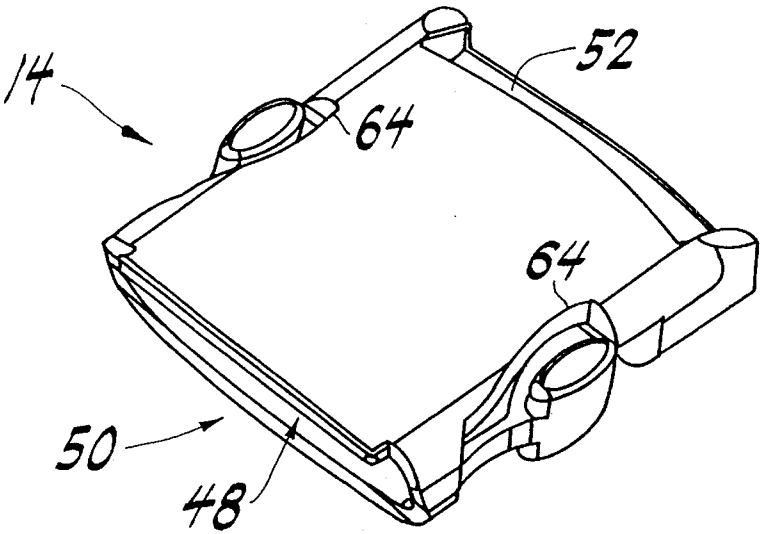
FIG. 7 is a perspective view of a female member in accordance with the invention.

Each enlarged portion 28 has the shape of a truncated triangle including two base segments defining upper and lower abutment surfaces 38, 40. The abutment surfaces 38, 40 are spaced apart from each other on opposite sides of the stem portion 26 of each arm 24. The abutment surfaces 38, 40 substantially face the base portion 16. As shown in FIG. 2, the abutment surfaces 38, 40 also each extend between the inner and outer sides 30, 32 of each arm stem 26. The geometric center of each abutment surface is substantially aligned with a longitudinal axis 41 extending through the arm stems 26.

The male member also includes a center alignment arm 42 to facilitate insertion and alignment of the male member 12 when coupled with the female member 14. The center arm 42 extends generally perpendicularly to the cross-members 18, 20 of the base portion 16 and is disposed between the arms 24. The free end 44 of the center arm 42 distal to the base portion 16 is tapered to facilitate insertion in the female member 14 as will be described below.

FIGS. 7–12 illustrate the female receptacle member 14 in greater detail. The female member 14 comprises a body with a cavity 48 therein adapted for receiving the arms 24 of the male member 12. The female member body includes a rear end with an opening 50 therein leading to the cavity 48. A cross-member 52 is provided at the opposite front end of the female member body on which the end of a strap, belt or the like (not shown) may be fastened.

Figure 9:
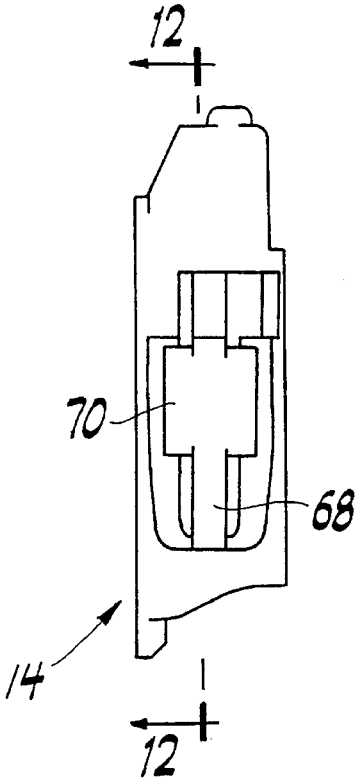
FIG. 9 is right-side view of the female member.
Figure 10:
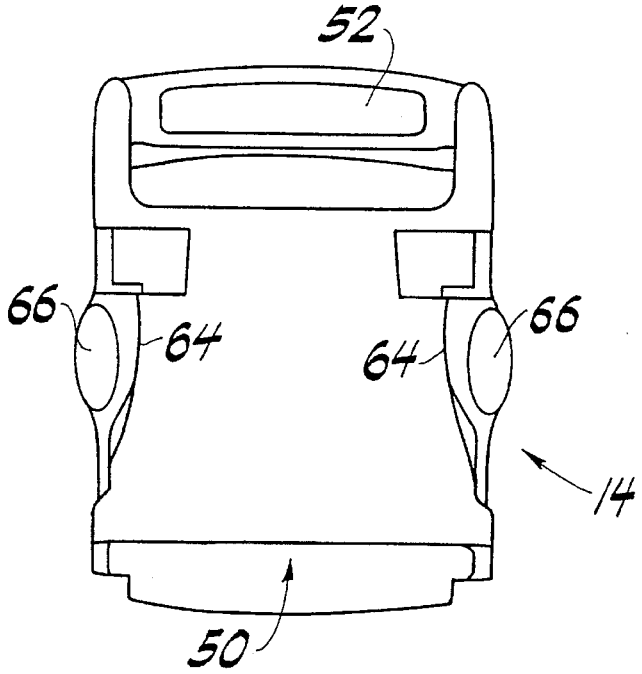
FIG. 10 is a bottom view of the female member.
Figure 11:
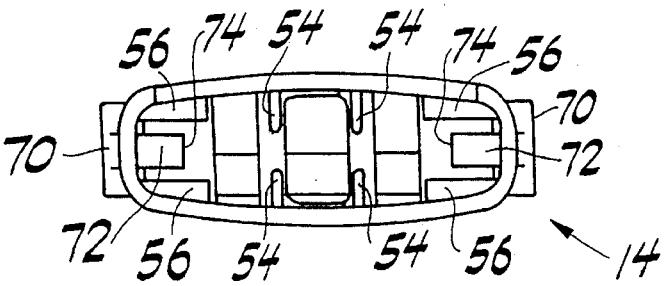
FIG. 11 is a rear view of the female member.
Figure 13:
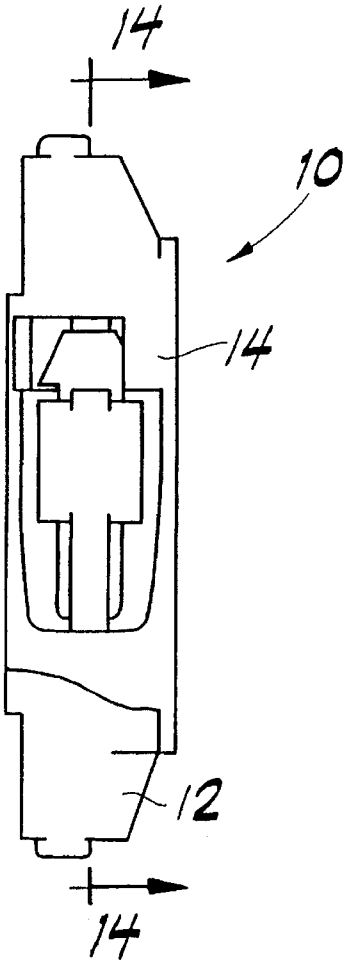
FIG. 13 is a left-side view of the assembled buckle shown in FIG. 1.
Figure 12:
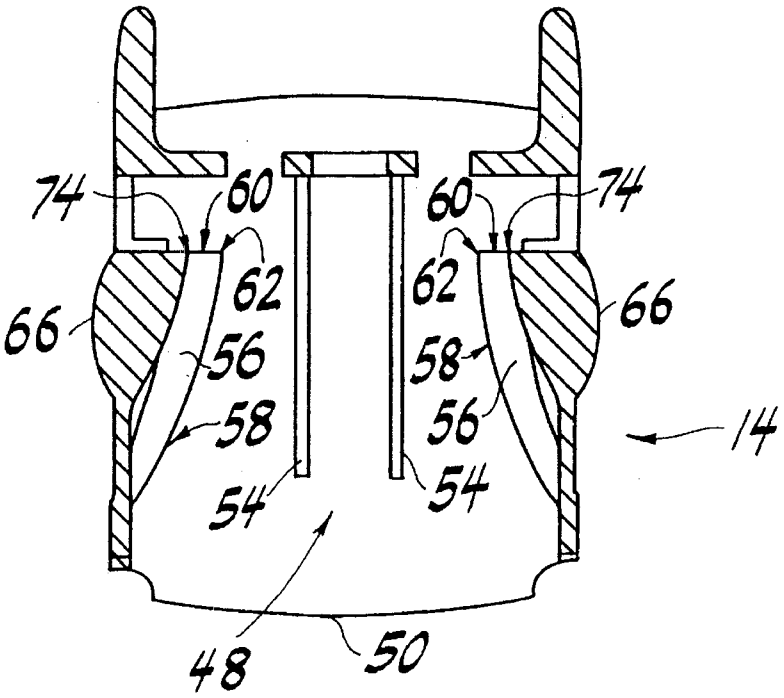
FIG. 12 is a cross-section view of the female member taken generally along lines 12—12 of FIG. 9.
Figure 16:
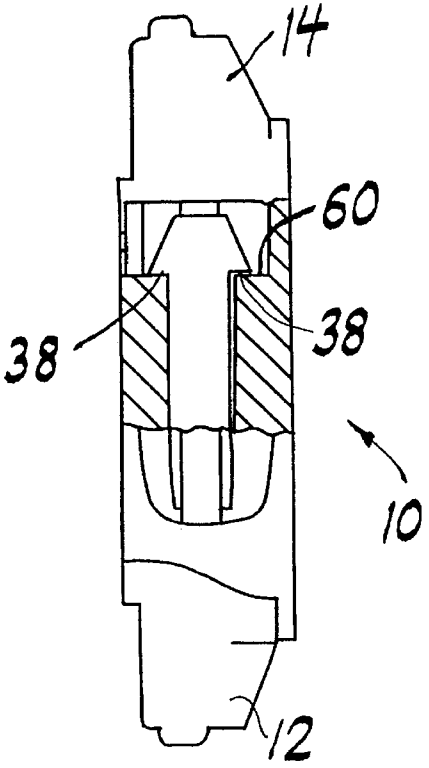
FIG. 16 is a partial cut-away view of the left-side of the buckle also illustrating the coupling arrangement of the male and female members.
Figure 15:
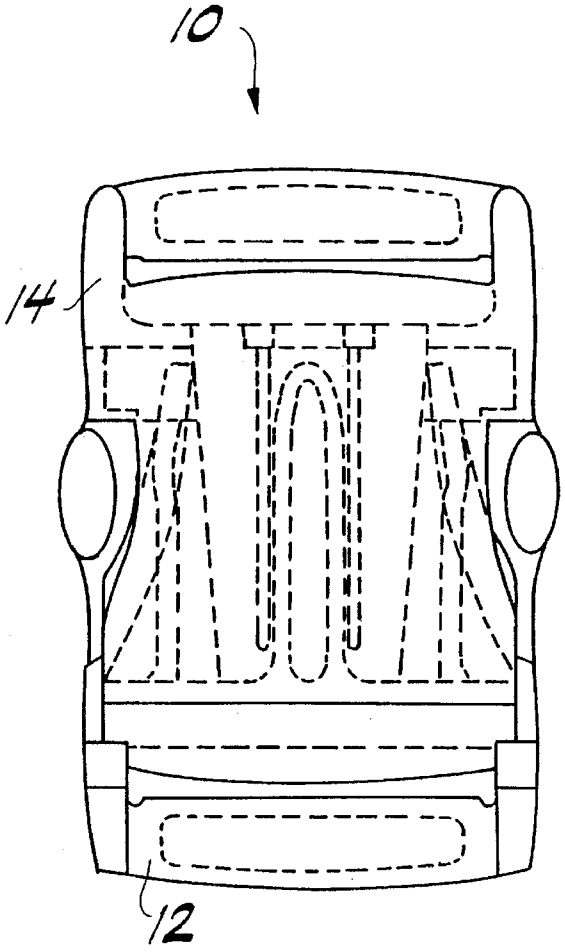
FIG. 15 is a top view of the buckle showing the coupling arrangement of the internal portions of the male and female members in a dotted outline.
Figure 14:
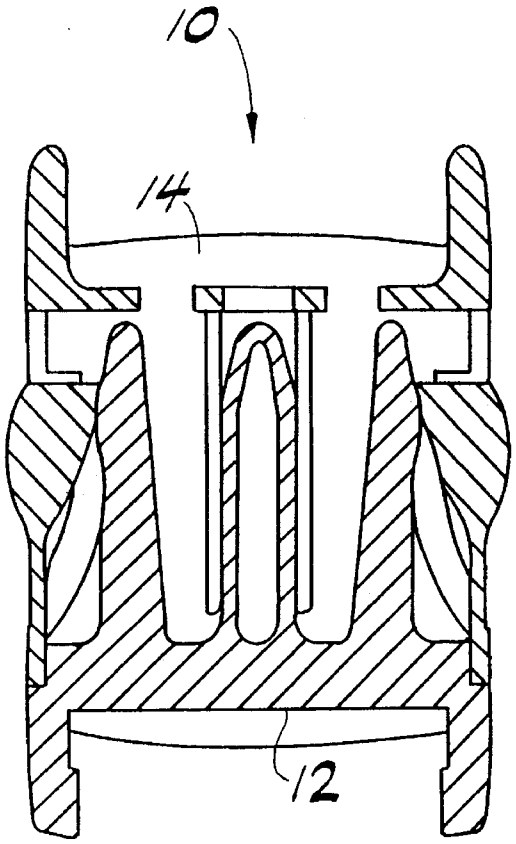
FIG. 14 is a cross-section view of the buckle taken generally along lines 14—14 of FIG. 13.

FIG. 12 is a cross-section view of the female member 14 taken generally along lines 12—12 of FIG. 9, illustrating an upper interior side of the female member. The opposite lower interior side of the body, which is integrally formed with the upper side, has a similar design as is apparent from FIG. 11. A pair of parallel center ridges 54 extend into the cavity 48 defining a channel therebetween on both the upper and lower interior sides. The channels are arranged in the body for receiving the center arm 42 of the male member 12 when the male and female members are coupled.

Each interior side of the body also includes a pair of tapered outer ridges or ramps 56 extending into the cavity 48 as shown in FIGS. 11 and 12. The ramps 56 of each pair are spaced-apart and at opposite sides of the female member body. The ramps each include an elongated slide surface 58 facing one of the center ridges 54 at a slight angle and a retaining surface 60 facing the front end of the female member away from the opening 50 of the cavity 48. The retaining and slide surfaces 58, 60 of each ramp 56 are connected at a corner 62. Each of the four retaining surfaces 60 are adapted to engage one of the abutment surfaces 38 of the male member 12 to provide for a secure coupling of the buckle parts as will be described below.

As shown in FIGS. 7–10, the female member body also includes a pair side recesses 64 at opposite sides thereof leading to the interior cavity 48. An actuating member 66 is disposed in each of the side recesses 64 for resilient movement therein. The actuating members 66 each comprise an elongated arm 68 having one end connected to the female member body, an enlarged grip 70 connected to an opposite end of the arm 68, and an extension member 72 projecting from the grip 70. The grip 70 is adapted for being pressed by the user's fingers. The extension member 72 includes a tip 74 at the end thereof that projects into the body cavity between two tapered outer ridges 56 (see FIGS. 11 and 12). Each actuating member 66 is adapted to be resiliently moved into one of the side recesses 64 such that the tip 74 of the extension member 72 projects inwardly beyond the corners 62 of the tapered ridges 56. As will be described below, the actuating members, when pressed, enables the male member 12 to be readily disconnected from the female member 14.

To couple the male and female members 12, 14, the free ends of the outer and center arms 24, 42 of the male member 12 are first inserted in the opening 50 of the female member body. Initially, the tapered end 44 of the center arm 42 engages the ends of the center ridges 54 in the cavity 48 of the female member body, which has the effect of aligning and centering the male member 12 relative to the female member 14. As the male member 12 is pushed further in the cavity 48, the outer sides 32 of the elongated arms 24 engage the slide surfaces 58 of the ramps 56 in the cavity 48. The ramps 56 are tapered, causing the free ends of the arms 24 of the male member 12 to resiliently flex inwardly toward each other from an originally unstressed configuration. Upon further pressing of the male member 12 in the cavity 48, the enlarged portions 28 at the end of the each arm 24 clear the corners 62 of the ramps 56 and snap outwardly to their original unstressed form (FIGS. 13–16). In this position, each of the two abutment surfaces 38 on each arm 24 directly oppose and are engageable with one of the retaining surfaces 60 in the female member 14 as is apparent from FIG. 16. Any attempt to pull apart the coupled male and female members 12, 14 with pull-apart forces without actuation of the actuating members 66 will force the abutment surfaces 38 against the retaining surfaces 60, creating an effective array of resistive forces that directly oppose (at 180°) the pull-apart forces. The particular configuration of spaced-apart abutment surfaces on the male member arms permits the abutment surfaces to be aligned with the longitudinal axis of the arms. Thus, the pull-apart forces applied through the arms of the male member substantially coincide with the opposing resistive forces, minimizing formation of torque or moments therefrom that may cause the abutment and retaining surfaces to become disengaged. Accordingly, the buckle in accordance with the present invention provides for an extremely secure coupling of the male and female members under heavy loads and guards against unintentional uncoupling.

To disengage the male and female members 12, 14, the actuating members 66 on each side of the female member are resiliently pressed inwardly toward each other causing the extension member 72 of each actuating member to engage the outer side 32 of each of the arms 24 and to urge the arms 24 inwardly toward each other. The abutment surfaces 38 on the arms are thereby moved inwardly relative to the retaining surfaces 60 of the female member 14. When the abutment surfaces 38 clear the corners 62 of the ramps 56, the abutment and retaining surfaces become disengaged. The male member is then thrusted out of the receptacle by resilient forces exerted by the arms 24 against the tapered slide surfaces 58 of the ramps 56. The male and female members can thus be quickly and easily separated when desired.

The spaced-apart configuration of the abutment surfaces 38 on the arms 24 of the male member on opposite sides of the arm stems 26 is also advantageous because it enables the actuating members 66 to engage the arms 24 at any location along the length thereof including at locations on the arm stems 26 for disengagement of the male and female members. Buckles in-accordance with the present invention can thus have a shorter overall length and be more compact than prior art devices, which by contrast, have only a single elongated abutment surface on each arm and must be pressed by the actuating member at a location between the abutment surface and the free end of each arm. The free ends of the arms are substantially enlarged in order to provide an effective surface for engaging the actuating member. Consequently, buckles in accordance with the prior art are substantially longer than those of the present invention.

Moreover, buckles in accordance with the present invention can have a smaller width and be more compact than prior art brackets because the presence of the actuating members allows the arms of the male member to be easily engaged even if they are located nearer to the center of the buckle.

The present invention has been described in the foregoing specification with respect to a specific embodiment that serves as an example to illustrate the invention rather than to limit its scope. Modifications may be made thereto without departing from the broader teachings of the invention.

I claim:

1. A two-piece buckle, comprising:

a male member including a base portion and two arms extending outwardly therefrom, said arms each including at a free end distal said base portion an upper abutment surface and a lower abutment surface wherein said upper and lower abutment surfaces are discrete and spaced-apart from each other, wherein each arm includes a longitudinal axis extending therethrough, and for each arm the upper and lower abutment surfaces are located opposite sides of the longitudinal axis of said arm; and a female member including a body with a cavity therein for receiving said arms of said male member, said body including a plurality of retaining surfaces, each corresponding to one of said abutment surfaces of said male member and adapted for engaging said abutment surface when the male and female members are coupled to resist separation thereof, the female member also including two actuating members, each engageable with one of said arms for disengaging said abutment surfaces from corresponding retaining surfaces and thereby uncoupling the male and female members when desired.

2. The buckle of claim 1, wherein each of said arms includes opposite inner and outer sides wherein the inner side of one arm faces the inner side of the other arm, and wherein the abutment surfaces extend between the inner and outer sides of each arm.

3. The buckle of claim 2, wherein each of said arms further comprises an upper side and an opposite lower side connecting said inner and outer sides, and wherein said upper abutment surface extends upwardly from said upper side and said lower abutment surface extends downwardly from said lower side.

4. The buckle of claim 1, wherein each said arm includes an enlarged portion at the free end thereof, and wherein said abutment surfaces are located at said enlarged portion.

5. The buckle of claim 4, wherein said enlarged portion has a truncated triangle shape that includes two spaced-apart base segments facing said base portion of said male member, and wherein said abutment surfaces are located at said base segments.

6. The buckle of claim 1, wherein said abutment surfaces of each arm are each oriented in a plane generally perpendicular to said longitudinal axis of said arm.

7. The buckle of claim 1, wherein said arms each comprise an elongated arm stem and wherein said upper and lower abutment surfaces are located on opposite sides of said arm stem.

8. The buckle of claim 1, wherein the male member further comprises a center arm extending outwardly from said base portion and disposed between said two arms.

9. The buckle of claim 8, wherein the center arm includes a tapered free end distal said base portion.

10. The buckle of claim 8, wherein the body includes center ridges therein defining a channel adapted for receiving the center arm for facilitating insertion and alignment of the male member when coupled with the female member.

11. The buckle of claim 1, wherein said base portion includes at least one cross member on which a strap may be attached, and wherein said cross member is oriented generally perpendicular to said arms.

12. The buckle of claim 1, wherein said body includes two side recesses leading to said cavity, and wherein each actuating member is disposed in one of said side recesses for resilient movement therein.

13. The buckle of claim 12, wherein each said actuating member includes a stem connected to the body, an enlarged grip connected to said stem, and an extension member projecting from said grip toward said cavity.

14. The buckle of claim 12, wherein the body of the female member includes two pairs of ramps therein, each ramp being proximate one of the side recesses and including a widened end defining one of said retaining surfaces.

15. The buckle of claim 14, wherein each actuating member is resiliently extendable between two of said ramps and is adapted to engage one of the arms of said male member and to move said arm such that the abutting surfaces of said arm are disengaged from corresponding retaining surfaces of the body.

16. The buckle of claim 1, wherein each actuating member is engageable with one of said arms at a location on said arm between said abutment surfaces and said base portion.

17. The buckle of claim 1, wherein the male and female members each comprise molded plastic.

18. The buckle of claim 1, further comprising means for biasing said abutment surfaces of each male member toward corresponding retaining surfaces of said female member when the male and female members are coupled.

19. A two-piece side release buckle fastener, comprising:

a male plug member including a base portion and two resilient arms extending outwardly therefrom, said arms each including a free end distal said base portion and upper and lower abutment surfaces at said free end, wherein said upper and lower abutment surfaces are discrete and spaced-apart from each other and oriented in a plane substantially facing said base portion wherein each said arm includes a longitudinal axis therethrough, and said axis extends through a location between the upper and lower abutment surfaces of said arm; and a female receptacle member releasably connectable with said male member, said female member including a body with a cavity therein for receiving said arms of said male member to releasably lock said arms therein, said body including a plurality of retaining surfaces, each corresponding to one of said abutment surfaces of said male member and adapted for engaging said abutment surface when the male and female members are coupled to resist separation thereof, the female member also including two actuating members adapted for disengaging said abutment surfaces from corresponding retaining surfaces to enable the male and female members to be uncoupled when desired.

20. The buckle of claim 19, wherein each said arm includes an enlarged portion at the free end thereof, and wherein said abutment surfaces are located at said enlarged portion.

21. The buckle of claim 20, wherein said enlarged portion has a truncated triangle shape having two spaced-apart base segments defining said abutment surfaces.

22. The buckle of claim 19, wherein said abutment surfaces of each arm are each oriented in a plane generally perpendicular to said longitudinal axis of said arm.

23. The buckle of claim 19, wherein said arms each comprise an elongated arm stem and wherein said upper and lower abutment surfaces are located on opposite sides of said arm stem.

24. The buckle of claim 19, wherein said base portion includes a cross member on which a strap may be attached, and wherein said cross member is oriented generally perpendicular to said arms.

25. The buckle of claim 19, wherein said body includes two side recesses leading, to said cavity, and wherein each actuating member is disposed in one of said side recesses for resilient movement therein.

26. The buckle of claim 25, wherein the body of the female member includes two pairs of tapered ridges therein, each pair being proximate one of the side recesses and each ridge including a widened end defining one of said retaining surfaces.

27. The buckle of claim 26, wherein each actuating member is resiliently extendable between two of said tapered ridges and is adapted to engage one of the arms of said male member and to move said arm such that the abutting surfaces of said arm are disengaged from corresponding retaining surfaces of the body.

28. The buckle of claim 19, wherein each actuating member is engageable with one of said arms at a location on said arm between said abutment surfaces and said base portion.

29. The buckle of claim 19, wherein the male and female members each comprise molded plastic.

30. A side-release buckle fastener, comprising:

a plug member including a base portion and two resilient arms extending outwardly therefrom, said arms each including a free end distal said base portion and upper and lower abutment surfaces at said free end, wherein said upper and lower abutment surfaces are discrete and spaced-apart from each other and oriented in a plane substantially facing said base portion, wherein each said arm includes a longitudinal axis extending therethrough and said longitudinal axis intersects an axis extending between the upper abutment surface and the lower abutment surface of said arm; and a receptacle for releasably coupling said plug member, said receptacle including a body with a cavity therein for receiving said arms of said plug member to releasably lock said arms therein, said body including a plurality of retaining surfaces, each corresponding to one of said abutment surfaces of said plug member and adapted for engaging said abutment surface when the plug member and receptacle are coupled to resist uncoupling thereof, the receptacle also including two actuating members adapted for disengaging said abutment surfaces from corresponding retaining surfaces to enable the plug member and receptacle to be uncoupled when desired.

31. A two-piece buckle, comprising:

a male member including a base portion and two arms extending outwardly therefrom, said arms each including a longitudinal axis extending therethrough;

a female member including a body with a cavity therein for receiving and releasably coupling said arms of said male member, said female member also including two actuating members engageable with said arms for uncoupling said male and female members when desired; and means for substantially aligning forces opposing any pull-out forces applied on the buckle to separate the male and female members without actuation of the actuating members with the longitudinal axes of said arms to substantially eliminate torque or rotational forces on said arms.

* * * * *